US009039846B2

(12) United States Patent
Bouzekri

(10) Patent No.: US 9,039,846 B2
(45) Date of Patent: May 26, 2015

(54) COLD-ROLLED ALUMINUM KILLED STEEL SHEET AND METHOD OF MANUFACTURING PACKAGING FROM SAID SHEET

(75) Inventor: Mohamed Bouzekri, Rombas (FR)

(73) Assignee: USINOR, Puteaux (FR)

( * ) Notice: Subject to any disclaimer, the term of this patent is extended or adjusted under 35 U.S.C. 154(b) by 355 days.

(21) Appl. No.: 10/391,529

(22) Filed: Mar. 19, 2003

(65) Prior Publication Data

US 2004/0011441 A1 Jan. 22, 2004

(30) Foreign Application Priority Data

Mar. 21, 2002 (FR) ..... 02 03514

(51) Int. Cl.

| | |
|---|---|
| ***C22C 38/04*** | (2006.01) |
| ***C22C 38/00*** | (2006.01) |
| ***C22C 38/06*** | (2006.01) |
| *C21D 8/04* | (2006.01) |
| *C21D 9/48* | (2006.01) |

(52) U.S. Cl.

CPC ..... *C22C 38/04* (2013.01); *C21D 8/0421* (2013.01); *C21D 8/0447* (2013.01); *C21D 9/48* (2013.01); *C22C 38/001* (2013.01); *C22C 38/06* (2013.01)

(58) Field of Classification Search

CPC ..... C22C 38/04; C22C 38/06; C22C 38/001; C21D 8/0421; C21D 8/0447; C21D 9/48

USPC ..... 148/320, 651, 650, 603; 420/128

See application file for complete search history.

(56) References Cited

U.S. PATENT DOCUMENTS

| | | | | |
|---|---|---|---|---|
| 2,171,040 | A * | 8/1939 | Merritt et al. | 220/62.17 |
| 5,779,047 | A * | 7/1998 | Darrah | 206/373 |
| 6,063,214 | A * | 5/2000 | Fujinaga et al. | 148/602 |
| 6,185,977 | B1 * | 2/2001 | Schiessl et al. | 72/342.1 |
| 6,673,170 | B1 * | 1/2004 | Bouzekri | 148/602 |

FOREIGN PATENT DOCUMENTS

| | | | |
|---|---|---|---|
| EP | 0 360 955 | A2 | 4/1990 |
| EP | 0 680 884 | A1 | 4/1995 |
| EP | 0 761 835 | A1 | 3/1997 |
| EP | 1 088 905 | A1 | 4/2001 |
| JP | 55-73824 | | 6/1980 |
| JP | 55-152129 | | 11/1980 |
| JP | 58-164752 | | 9/1983 |
| JP | 05-112829 | * | 5/1993 |
| JP | 06-093329 | * | 4/1994 |
| JP | 06-220581 | * | 9/1994 |
| JP | 7-216502 | | 8/1995 |

(Continued)

OTHER PUBLICATIONS

English Translation of Kobayashi et al. (JP 06-093329).*

*Primary Examiner* — Jessee Roe

(74) *Attorney, Agent, or Firm* — Sughrue Mion, PLLC; Richard C. Turner

(57) ABSTRACT

The invention concerns a cold-rolled aluminum killed steel sheet, which includes by weight between 0.003 and 0.130% of carbon, between 0.10 and 1% of manganese, between 0.010 and 0.100% of aluminum, between 0.0015 and 0.0140% nitrogen, the remainder being of iron and impurities resulting from the manufacturing, and which has a content of carbon in solid solution (Css) of at least 50 ppm, as well as a method of manufacturing packaging from said sheet.

12 Claims, 1 Drawing Sheet

(56) References Cited

FOREIGN PATENT DOCUMENTS

| | | | | |
|---|---|---|---|---|
| JP | 8-73943 | 3/1996 | | |
| JP | 8-157959 | 6/1996 | | |
| JP | 8-157961 | 6/1996 | | |
| JP | 10-330845 | 12/1998 | | |
| JP | 411314103 | * 11/1999 | ..... | B21B 1/22 |
| JP | 2003-96543 | * 4/2004 | ..... | C21D 9/46 |

* cited by examiner

COLD-ROLLED ALUMINUM KILLED STEEL SHEET AND METHOD OF MANUFACTURING PACKAGING FROM SAID SHEET

The present invention concerns a cold-rolled aluminum killed steel sheet intended for manufacturing of packaging, as well as a method of manufacturing packaging, with application in the field of metallic packaging for food, non-food or industrial products.

BACKGROUND OF THE INVENTION

Beverage can type packages are manufactured from steel sheet, and a distinction is generally made between two-piece packages comprised of a bottom and a body, having a side wall and a bottom, and three-piece packages comprised of an electrically welded body and two bottoms.

The two-piece packages are produced by drawing under a blank-holder, or by drawing/finishing for beverage cans, and are generally in the form of axisymmetrical, cylindrical or truncated-cone shaped cans.

When a beverage can bottom is manufactured, for example, after the forming stage a joint is made in the crimped pan to ensure the imperviousness of the package, and the whole unit is heat treated to polymerize the joint.

The thicknesses of the steel sheets for packaging vary from 0.12 mm to 0.25 mm for the great majority of uses, but can be of greater thicknesses, up to 0.49 mm for very special applications. They can also be as thin as 0.08 mm, for example in the case of food trays.

Packagers are showing more and more interest in thinner steels, from 0.12 mm to 0.075 mm, and in an effort to differentiate themselves from competitors, they are looking for ways to innovate in more and more complex ways. Hence there is a demand for cans in original shapes, manufactured with very thin steel sheet which, because of the greater difficulties in forming, must meet particular criteria of use such as mechanical behavior, resistance to the axial load they undergo when stacked for storage, resistance to the internal overpressure they undergo during the heat treatment for sterilization and the internal underpressure they undergo after cooling. The steel sheet must therefore have a very high tensile strength (Rm) and good ductility.

In practice, however, a very great dispersion is observed of the physical properties of packaging obtained after forming and heat treatment of steel sheet. Thus, for a package bottom, the values of the non-return pressure and overlay pressure properties are widely dispersed.

This dispersion does not make it possible to ensure that the manufactured packages will be suitable for meeting the criteria of use mentioned above. Productivity is therefore necessarily reduced.

SUMMARY OF THE INVENTION

The purpose of the present invention is therefore to remedy the disadvantages of sheet metal of the prior art, making available a sheet that allows the manufacture of steel packaging having good mechanical strength and good ductility, and therefore physical properties of narrow dispersion.

DESCRIPTION OF THE INVENTION

To that end, a first object of the invention is composed of a cold-rolled aluminum killed sheet steel having by weight between 0.003 and 0.130% carbon, between 0.10 and 1% manganese, between 0.010 and 0.100% aluminum, between 0.0015 and 0.0140% nitrogen, the remainder being iron and impurities resulting from production, and in that it has a content of carbon in solid solution (Css) of at least 50 ppm.

The present inventor has noted in particular that there is a threshold for carbon in solid solution in the steel of the sheet before working, beyond which the mechanical characteristics of the packaging manufactured with this sheet vary little. By way of comparison, sheet of the prior art containing carbon in solid solution has values of up to a maximum of 15 to 30 ppm.

Furthermore, the sheet according to the invention can have the following characteristics, alone or in combination:

- the sheet has between 0.010 and 0.080% by weight of carbon, between 0.15 and 0.50% of manganese, between 0.0020 and 0.0060% nitrogen, and between 0.010 and 0.100% aluminum,
- the sheet has between 0.060 and 0.080% by weight of carbon, between 0.35 and 0.50% of manganese, between 0.0035 and 0.0060% nitrogen, and between 0.010 and 0.100% aluminum,
- the sheet has a rate of elongation of between 3 and 8%,
- the sheet has a limit of elasticity greater than 660 MPa, and preferably greater than 700 MPa.

More particularly, a sheet is preferable that makes it possible to achieve TH720 (DR10) quality having a limit of elasticity of more than 700 MPa after cold rolling.

A second object of the invention is a method of manufacturing packaging from aluminum killed steel, composed of the step of forming a cold-rolled sheet of aluminum killed steel, according to the invention, and possibly comprising a heat treatment of said formed sheet.

In a preferred form of embodiment, the forming of the sheet is a drawing operation.

In another preferred form of embodiment, the forming of the sheet is a drawing operation followed by finishing.

For the production of packaging, the use of standard aluminum killed low-carbon and low manganese steels is known.

The carbon content contemplated within the scope of the present invention is between 0.003% and 0.130%. In a first form of embodiment, carbon contents of between 0.010% and 0.080% by weight are preferred, for in this way sheet is obtained that has improved ductility, allowing packaging in complex shapes to be manufactured.

In a second form of embodiment, carbon contents between 0.060% and 0.080% by weight are preferred. A carbon content of more than 0.060% is selected in order to obtain a sheet that has a greater hardness. However, the carbon content is limited to 0.080%, because beyond that, difficulties in cold rolling are observed.

The manganese content contemplated within the scope of the present invention is between 0.10% and 1%. In a first preferred form of embodiment, the manganese content is between 0.15% and 0.50% by weight, which makes it possible to obtain sheet that is less hard. In a second preferred form of embodiment, the manganese content is between 0.35% and 0.50% by weight, which increases the age-hardening tendency of the sheet.

The nitrogen content within the scope of the present invention is between 0.0015% and 0.0140% by weight. However, it is preferred to limit the nitrogen content to between 0.0020% and 0.0060% in order to avoid excessive hardening of the steel by this element, which would degrade the cold rollability.

The steel sheets to be formed by the method according to the invention can be obtained by any suitable method. In particular, they can be manufactured in the standard way by hot rolling a slab, followed by cold rolling with a rate of reduction that is generally between 85% and more than 90%, but which can vary depending on the desired characteristics.

The principal factors involved in defining the cold reduction rate are the final thickness of the product, as well as the impact of the cold reduction rate on the microstructural condition, and as a result on the mechanical characteristics after recrystallization and annealing. Consequently, the more the cold reduction rate increases, the lower the recrystallization temperature, the smaller the grain size and the higher the Re and Rm. In particular, the reduction rate can have a very significant impact on the Lankford coefficient.

The sheet can then be annealed and skin-pass cold-rolled with a variable rate of elongation between 0.2% and 45%, depending on the contemplated level of tensile strength Rm or the limit of elasticity.

The annealing cycles used for these steels for packaging are built on the basis of the Mohri annealing cycle comprised of three phases of a duration of about 20 seconds and which is broken down into a heating phase to reach the holding temperature, then a holding phase, followed by a cooling phase down to the ambient temperature.

Sheets that are to be formed by the method according to the invention, however, must contain a minimum quantity of carbon in solid solution after they have been annealed. In particular, such a result can be obtained while maintaining the carbon in solid solution, by sufficiently rapid cooling after the phase of holding at a high temperature.

Depending on the composition of the steel and the characteristics that one wishes to obtain, maintaining the carbon in solid solution can be obtained with cooling speeds of between 7 and 600° C. per second. The faster the cooling speed, the greater the quantity of carbon in solid solution will be.

BRIEF DESCRIPTION OF THE DRAWINGS

The invention will be illustrated by the description of a form of embodiment given by way of non-limiting example, with reference to the attached figures in which.

EXAMPLE

1. Threshold of Carbon in Solid Solution (Css)

Three series of sheets are produced having carbon, manganese, aluminum and total nitrogen content, expressed in % by weight, as shown in the following table:

| Series | Carbon | Manganese | Aluminum | Nitrogen |
|---|---|---|---|---|
| A | 0.053 | 0.424 | 0.047 | 0.0053 |
| B | 0.072 | 0.314 | 0.017 | 0.0049 |
| C | 0.062 | 0.352 | 0.016 | 0.0104 |

The remainder of the composition is made up of iron and the inevitable impurities.

Each series of sheets contains variable quantities of carbon in solid solution, obtained by an annealing that has the following characteristics:

heating time: 20 sec.

holding temperature: 680° C.

holding time: 20 sec time to cool down to ambient temperature: between 7° C. and 10° C. per second.

After this annealing, the sheets are cold-rolled at an elongation rate of 5%, followed by an age-hardening treatment of 20 minutes at 200° C.

The content of carbon in solid solution of these sheets is determined either by measuring the internal friction coefficient, or by measuring the thermoelectric power using a standard protocol.

Figure 1:
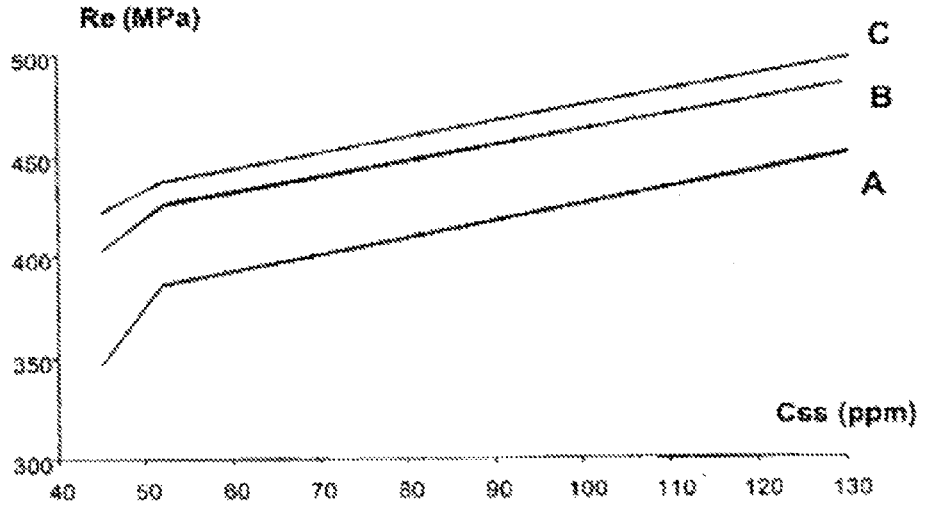
FIG. 1 shows a curve of measurement of the limit of elasticity Re of cold-rolled sheet, as a function of their content of carbon in solid solution (Css)

The limits of elasticity of these three series of sheets is then measured, and the results are presented in FIG. 1.

It will be noted that, up to a threshold of about 50 ppm, the limit of elasticity varies very widely as a function of the packaging's content of carbon in solid solution. The slope of all three curves exceeds 1.5 MPa/ppm (curve A: 7.5 MPa/ppm, curve B: 3 MPa/ppm, curve C: 1.5 MPa/ppm). Now, a characteristic such as non-return pressure is directly proportional to the value of the limit of elasticity of the sheet before forming. This wide variation in the limit of elasticity therefore results in a wide dispersion of the non-return pressure.

On the contrary, however, beyond 50 ppm of carbon in solid solution, it is observed that the limit of elasticity varies much less, resulting in a low dispersion of physical properties of the manufactured packaging. The slope of the three curves is then no more than 0.7 MPa/ppm.

Another characteristic of the three series of sheets is their content in nitrogen in solid solution. Series A does not contain any, while series B contains 50 ppm and series C contains 100 ppm. It will be noted that this nitrogen in solid solution does not affect the dispersion of the limit of elasticity of the sheets, beyond the threshold of 50 ppm of carbon in solid solution.

2. Tensile Strength Rm

A series of test samples of composition A is manufactured, having 52 ppm of carbon in solid solution, and after an annealing similar to the one described in point 1, they are cold-rolled with a variable rate of skin-pass elongation.

Figure 2:
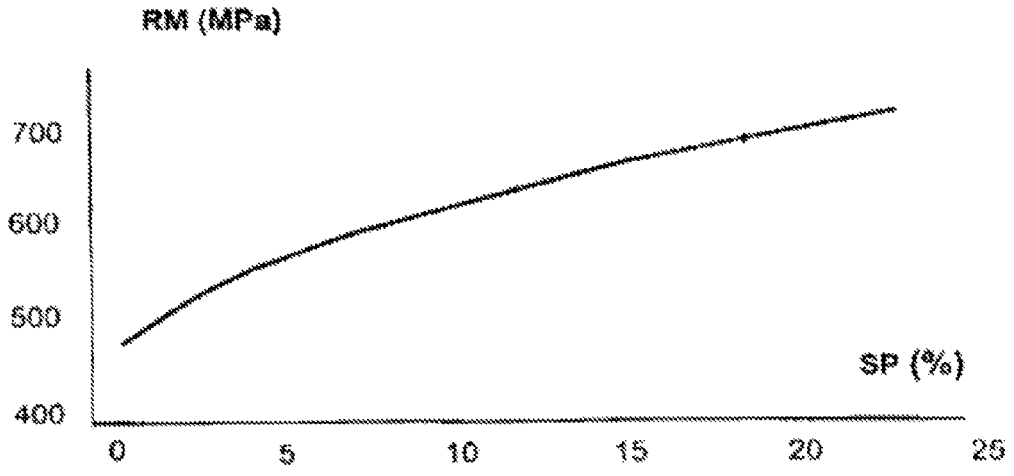
FIG. 2 shows a curve of measurement of the tensile strength Rm of test samples, as a function of their rate of skin-pass (SP) elongation during cold-rolling.

The results of these tests are represented in the curve of FIG. 2. This shows that the sheet according to the invention makes it possible to achieve levels of Rm exceeding 700 MPa for rates of skin-pass elongation of less than 30%, which is a value that is industrially quite achievable.

The invention claimed is:

1. A cold-rolled aluminum killed sheet steel, comprising, by weight, between 0.053 and 0.080% carbon, between 0.15 and 0.424% manganese, between 0.010 and 0.100% aluminum, between 0.0020 and 0.0060% nitrogen, the remainder being iron and impurities resulting from production, and wherein the steel has a content of carbon in solid solution (Css) of at least 52 ppm, wherein the sheet has a rate of elongation of between 3 and 8%.

2. The sheet according to claim 1, wherein the sheet has a limit of elasticity greater than 660 MPa.

3. The sheet according to claim 2, wherein the sheet has a limit of elasticity greater than 700 MPa.

4. The sheet according to claim 2, wherein the sheet has a limit of elasticity greater than 660 MPa.

5. Sheet according to claim 4, wherein the sheet has a limit of elasticity greater than 700 MPa.

6. The sheet according to the claim 1, comprising between 0.060 and 0.080% by weight of carbon, between 0.35 and 0.424% of manganese, between 0.0035 and 0.0060% nitrogen, and between 0.010 and 0.100% aluminum.

7. The sheet according to claim 6, wherein the sheet has a limit of elasticity greater than 660 MPa.

8. Sheet according to claim 7, wherein the sheet has a limit of elasticity greater than 700 MPa.

9. Method of manufacturing packaging from aluminum killed steel, comprising a step of forming a cold-rolled sheet of aluminum killed steel according to any of the claim 1, 6, 2 or 3.

10. The method according to the claim 9, wherein the forming step is a drawing operation.

11. The method according to claim 9, wherein said forming step is a drawing operation followed by finishing.

12. Method of manufacturing packaging according to claim 9, further comprising a heat treatment of said formed sheet.

* * * * *